US011618254B2

(12) United States Patent
Yasuda et al.

(10) Patent No.: US 11,618,254 B2
(45) Date of Patent: Apr. 4, 2023

(54) ELEMENT SUBSTRATE, LIQUID DISCHARGE HEAD, AND PRINTING APPARATUS

(71) Applicant: CANON KABUSHIKI KAISHA, Tokyo (JP)

(72) Inventors: Takeru Yasuda, Kanagawa (JP); Maki Kato, Tokyo (JP); Yuzuru Ishida, Kanagawa (JP); Yoshinori Misumi, Tokyo (JP); Tsubasa Funabashi, Oita (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/337,138

(22) Filed: Jun. 2, 2021

(65) Prior Publication Data

US 2021/0379890 A1 Dec. 9, 2021

(30) Foreign Application Priority Data

Jun. 3, 2020 (JP) ..... JP2020-097144

(51) Int. Cl.
*B41J 2/14* (2006.01)

(52) U.S. Cl.
CPC ..... *B41J 2/14129* (2013.01); *B41J 2/14064* (2013.01); *B41J 2/14072* (2013.01); *B41J 2202/13* (2013.01); *B41J 2202/18* (2013.01)

(58) Field of Classification Search
CPC ..... B41J 2/14129; B41J 2/14064; B41J 2/14072; B41J 2202/13; B41J 2202/18
See application file for complete search history.

(56) References Cited

U.S. PATENT DOCUMENTS

| | | | | |
|---|---|---|---|---|
| 6,530,650 | B2 | 3/2003 | Ozaki et al. | |
| 9,085,143 | B2 | 7/2015 | Ishida et al. | |
| 9,096,059 | B2 | 8/2015 | Hatsui et al. | |
| 10,603,912 | B2 * | 3/2020 | Miura | H05K 1/0212 |

FOREIGN PATENT DOCUMENTS

| | | |
|---|---|---|
| JP | 4-320849 A | 11/1992 |
| JP | 2016-137705 A | 8/2016 |

* cited by examiner

*Primary Examiner* — Geoffrey S Mruk
(74) *Attorney, Agent, or Firm* — Venable LLP

(57) ABSTRACT

An element substrate of multi-layer structure, comprising an electrothermal transducing element formed in a first layer, a protective film covering the electrothermal transducing element, an anti-cavitation film formed on the protective film, a first electrical wire formed in the same layer as the anti-cavitation film, arranged to be separated from the electrothermal transducing element, and electrically connected to at least one end of the electrothermal transducing element, a second electrical wire on an opposite side, in relation to the electrothermal transducing element, to the protective film, and formed in a second layer, and a first connection member that extends between the first and second layers, and that electrically connects the first and second electrical wires.

14 Claims, 7 Drawing Sheets

ELEMENT SUBSTRATE, LIQUID DISCHARGE HEAD, AND PRINTING APPARATUS

BACKGROUND OF THE INVENTION

Field of the Invention

The present invention relates to an element substrate, a liquid discharge head, and a printing apparatus, and in particular relates to a printing apparatus that applies, as a printhead, a liquid discharge head in which an element substrate for preventing melting due to ink, for example, is embedded, in order to perform printing in accordance with an inkjet method.

Description of the Related Art

As an information output apparatus such as a word processor, a personal computer, a facsimile, or the like, printing apparatuses that perform printing, onto a sheet-shaped print medium such as a piece of paper or a film, of information such as desired text, images, or the like are generally widely used. In Japanese Patent Laid-Open No. H4-320849, a printhead in which an electrothermal transducing element is used is disclosed. According to this document, a pair of electrical wires are connected to an electrothermal transducing element arranged on an element substrate, and a portion sandwiched by the ends of the pair of electrical wires defines the substantial electrothermal transducing element region. Electrical wire is arranged on the electrothermal transducing element back-surface when the element substrate is viewed as a plane, that is the electrical wire is arranged on the surface on the discharge port side of the electrothermal transducing element. The end of the electrical wire has a tapered shape. To protect the electrical wire and the electrothermal transducing element from liquid (ink), the electrical wire and the electrothermal transducing element are covered with a protective film.

With such a configuration, a current is supplied by applying voltage from the electrical wire to the electrothermal transducing element, and film boiling is caused to occur in a liquid such as ink by causing the electrothermal transducing element to generate heat. The liquid is discharged from the discharge port by an air bubble that is produced at this time, and printing is thereby performed. With such a printhead, it is easy to have a large number of discharge ports and arrange the electrothermal transducing elements at high density, and consequently, a high-resolution printed image can be achieved.

Meanwhile, due to recent increases in the number of discharge ports and faster printing speeds, printhead power consumption is increasing. To prevent such power consumption, it is important to deliver heat generated by the electrothermal transducing element efficiently to the liquid. For that purpose, it is effective to make the thickness of the protective film that covers the electrothermal transducing element thin. However, a uniform thickness is needed to ensure the performance of the protection of the electrical wire and electrothermal transducing element by the protective film. Since the thickness of the electrical wire is large compared to the electrothermal transducing element, in particular, a large thickness is needed to reliably cover level differences of the boundary portions between the electrical wires and the electrothermal transducing element.

To address this need, for example, Japanese Patent Laid-Open No. 2016-137705 proposes a configuration that, in order to supply power to the electrothermal transducing element, arranges a connection member of a plug structure on the back surface of the electrothermal transducing element when viewing from the discharge port direction. By using such a configuration, the front surface including the electrothermal transducing element is planarized as much as possible, and the thickness of the protective film is reduced.

Conventionally, when planarizing an electrothermal transducing element deposit surface to make the thickness of the protective film smaller, normally, for example, a plug-type connection layer using a metallic material such as tungsten is used. In the case of using such a configuration, normally, stable printing is possible, and there is no difference in durability from conventional structures.

However, there are cases in which, due to the influence of an abnormal driving pulse being inputted to the printhead, or a small contaminant or the like floating within the ink, an incidental disconnection occurs in the electrothermal transducing element at a small probability. In the case of a configuration that uses a plug-type connection layer as described above, since a large current flows through the connection layer when the electrothermal transducing element is disconnected, the loss of the connection layer due to melting of plug material or shock is known to occur in many cases at the time of disconnection. When an abnormality as described above occurs in the connection layer, the ink present on the electrothermal transducing element intrudes into the lower wiring layer via a connection layer portion that became a cavity. In particular, there is the concern that corrosion of the wiring due to an electrochemical reaction when ink contacts an electrical wire to which a high voltage is being applied will advance, and that the wiring of an electrothermal transducing elements in the vicinity will also corrode.

SUMMARY OF THE INVENTION

The present invention was conceived in view of the above-described conventional examples, and has, an object, to reduce the thickness of a protective film, and also to provide an element substrate, a liquid discharge head, and a printing apparatus that can ensure high reliability even during an incidental malfunction.

One of the aspects of the present invention provides an element substrate of multi-layer structure, comprising an electrothermal transducing element formed in a first layer, a protective film covering the electrothermal transducing element, an anti-cavitation film formed on the protective film and for protecting the electrothermal transducing element from a shock, a first electrical wire formed in the same layer as the anti-cavitation film, in a direction along a planar face of the element substrate, a portion of the first electrical wire being arranged to be separated from the electrothermal transducing element, and electrically connected to at least one end of the electrothermal transducing element, a second electrical wire formed in a second layer that is positioned on an opposite side of, in relation to the electrothermal transducing element, the protective film, and a first connection member that extends between the first layer and the second layer, that electrically connects the first electrical wire and the second electrical wire, and that is arranged to be separated from the electrothermal transducing element in the direction along the planar face.

Further features of the present invention will become apparent from the following description of exemplary embodiments (with reference to the attached drawings).

DESCRIPTION OF THE EMBODIMENTS

A preferred embodiment of the present invention will now be described in more detail with reference to the accompanying drawings. Note, the following embodiments are not intended to limit the invention according to the scope of the claims. Although a plurality of features are described in the embodiments, some of the plurality of features may not be essential for the invention, and the plurality of features may be appropriately combined. Further, in the accompanying drawings, identical or similar configurations are denoted by identical reference numbers, and duplicate description will be omitted.

Note that in this specification, "print" encompasses forming not only meaningful information such as characters and shapes, but also meaningless information. Furthermore, "print" broadly encompasses cases in which an image or pattern is formed on a printing medium irrespective of whether or not it is something that a person can visually perceive, and cases in which a medium is processed.

Also, "print medium" broadly encompasses not only paper used in a typical printing apparatus, but also things that can receive ink such as cloths, plastic films, metal plates, glass, ceramics, wood materials, hides or the like.

Furthermore, similarly to the foregoing definition of "print", "ink" (also referred to as "liquid") should be broadly interpreted. Therefore, it is assumed that the liquid is a liquid which can be subjected to the formation of an image, a pattern, a pattern, or the like, or the processing of the printing medium, or the processing of the ink (for example, the solidification or insolubilization of the colorant in the ink to be applied to the printing medium) by being applied onto the printing medium.

Furthermore, "nozzle", unless specified otherwise, encompasses a discharge port and an element that produces energy that is used for discharge of ink and a fluid channel that communicates therewith collectively.

An element substrate for a printhead (a head substrate) used below does not indicate a mere substrate consisting of a silicon semiconductor but rather indicates a configuration in which elements, wiring, and the like are disposed.

Furthermore, "on the substrate" means not only simply on top of the element substrate, but also the surface of the element substrate, and the inside of the element substrate in the vicinity of the surface. Also, "built-in" in the present invention does not mean that separate elements are simply arranged as separate bodies on a substrate surface, but rather means that the elements are formed and manufactured integrally on the element board by a semiconductor circuit manufacturing process.

<Description of Outline of Printing Apparatus (FIGS. 1 and 2)>

Figure 1:
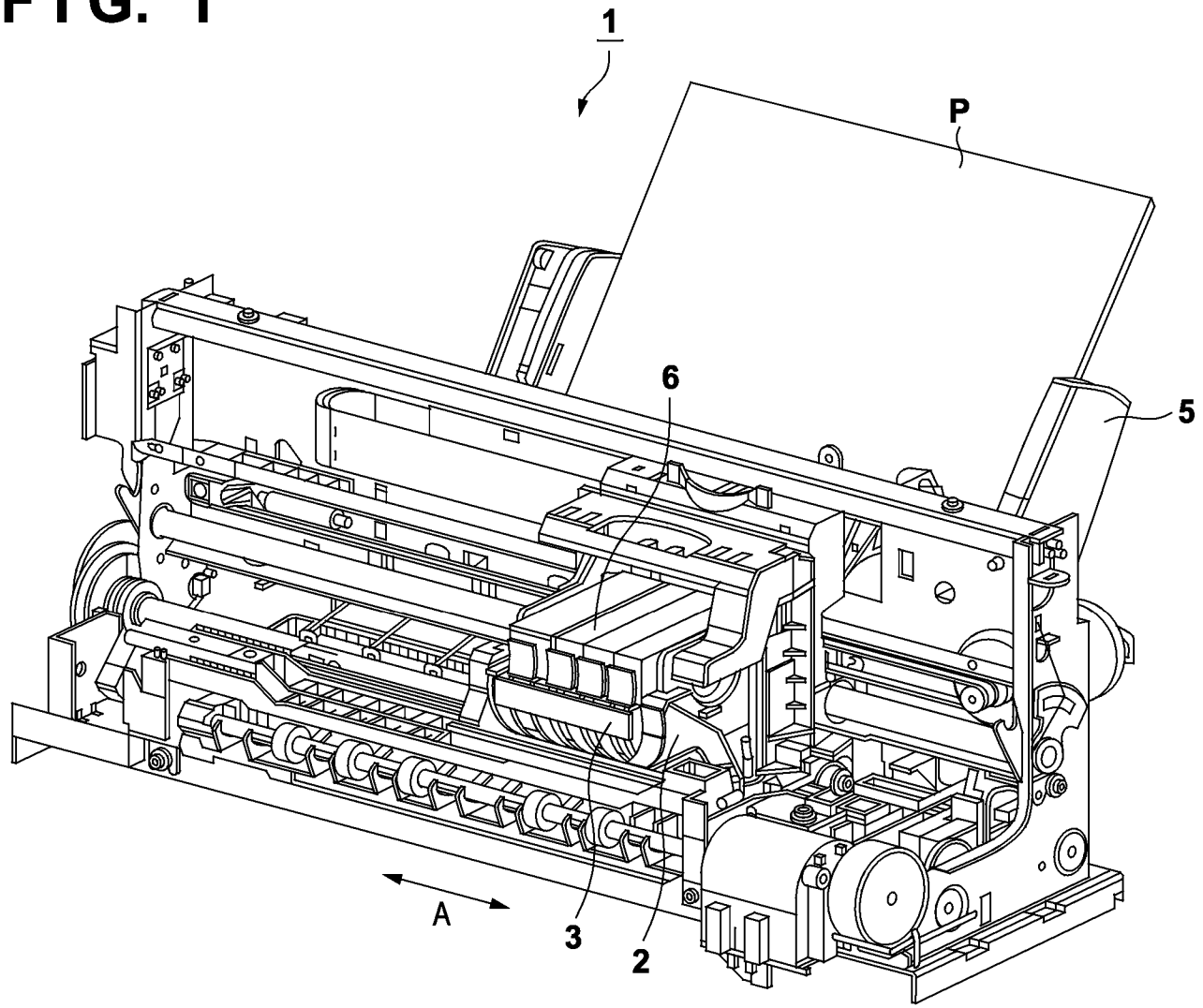
FIG. 1 is a perspective view illustrating a configuration overview of a printing apparatus comprising a printhead in a representative embodiment of the present invention.

FIG. 1 is an external perspective view showing the outline of the configuration of a printing apparatus that performs printing using an inkjet printhead (to be referred to as a printhead hereinafter) according to a representative embodiment of the present invention.

As shown in FIG. 1, in an inkjet printing apparatus (to be referred to as a printing apparatus hereinafter) 1, an inkjet printhead (to be referred to as a printhead hereinafter) 3 configured to discharge ink in accordance with an inkjet method to perform printing is mounted on a carriage 2. The carriage 2 is reciprocally moved in the direction of an arrow A to perform printing. A print medium P such as print paper is fed via a paper feed mechanism 5, conveyed to a printing position, and ink is discharged from the printhead 3 to the print medium P at the printing position, thereby performing printing.

In addition to the printhead 3, an ink tank 6 storing ink to be supplied to the printhead 3 is attached to the carriage 2 of the printing apparatus 1. The ink tank 6 is detachable from the carriage 2.

A printing apparatus 1 shown in FIG. 1 can perform color printing, and for the purpose, four ink cartridges storing magenta (M), cyan (C), yellow (Y), and black (K) inks, respectively, are mounted on the carriage 2. The four ink cartridges are detachable independently.

The printhead 3 according to this embodiment employs an inkjet method of discharging ink using thermal energy. Hence, the printhead 3 includes an electrothermal transducing element (heater). The electrothermal transducing element is provided in correspondence with each discharge port, and a pulse voltage is applied to a corresponding electrothermal transducing element in accordance with a print signal, thereby discharging ink from a corresponding discharge port. Note that the printing apparatus is not limited to the above-described serial type printing apparatus, and the embodiment can also be applied to a so-called full-line type printing apparatus in which a printhead (line head) with discharge ports arrayed in the widthwise direction of a print medium is arranged in the conveyance direction of the print medium.

Figure 2:
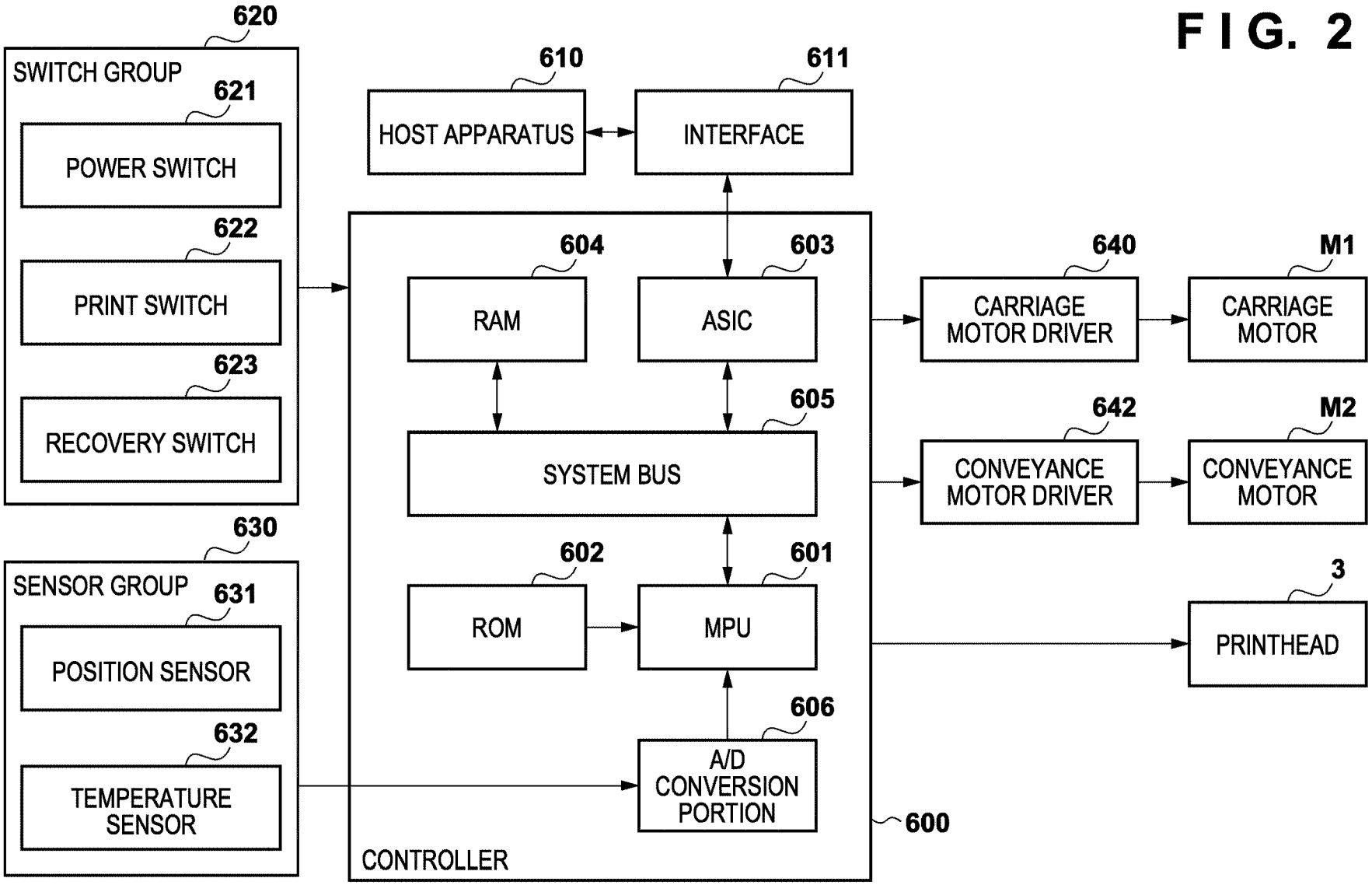
FIG. 2 is a block diagram illustrating a control configuration of a printing apparatus illustrated in FIG. 1.

FIG. 2 is a block diagram showing the control configuration of the printing apparatus shown in FIG. 1.

As shown in FIG. 2, a controller 600 is configured by an MPU 601, a ROM 602, an application-specific integrated circuit (ASIC) 603, a RAM 604, a system bus 605, an A/D converter 606, and the like. Here, the ROM 602 stores programs corresponding to control sequences to be described later, necessary tables, and other fixed data. The ASIC 603 generates control signals for control of a carriage motor M1, control of a conveyance motor M2, and control of the printhead 3. The RAM 604 is used as an image data loading region, a work region for program execution, and the like. The system bus 605 connects the MPU 601, the ASIC 603, and the RAM 604 to each other to exchange data. The A/D converter 606 receives an analog signal from a sensor group to be described below, performs A/D conversion, and supplies a digital signal to the MPU 601.

Additionally, referring to FIG. 2, reference numeral 610 denotes a host apparatus corresponding to a host shown in FIG. 1 or an MFP, which serves as an image data supply source. Image data, commands, statuses, and the like are transmitted/received by packet communication between the host apparatus 610 and the printing apparatus 1 via an interface (I/F) 611. Note that as the interface 611, a USB interface may be provided independently of a network interface to receive bit data or raster data serially transferred from the host.

Reference numeral 620 denotes a switch group which is configured by a power switch 621, a print switch 622, a recovery switch 623, and the like.

Reference numeral 630 denotes a sensor group configured to detect an apparatus state and formed by a position sensor 631, a temperature sensor 632, and the like.

Reference numeral 640 denotes a carriage motor driver that drives the carriage motor M1 configured to reciprocally scan the carriage 2 in the direction of the arrow A; and 642, a conveyance motor driver that drives the conveyance motor M2 configured to convey the print medium P.

The ASIC 603 transfers data used to drive a heating element (a heater for ink discharge) to the printhead while directly accessing a storage region of the RAM 604 at the time of print scan by the printhead 3. In addition, the printing apparatus includes a display unit configured by an LCD or an LED as a user interface.

Figure 3:
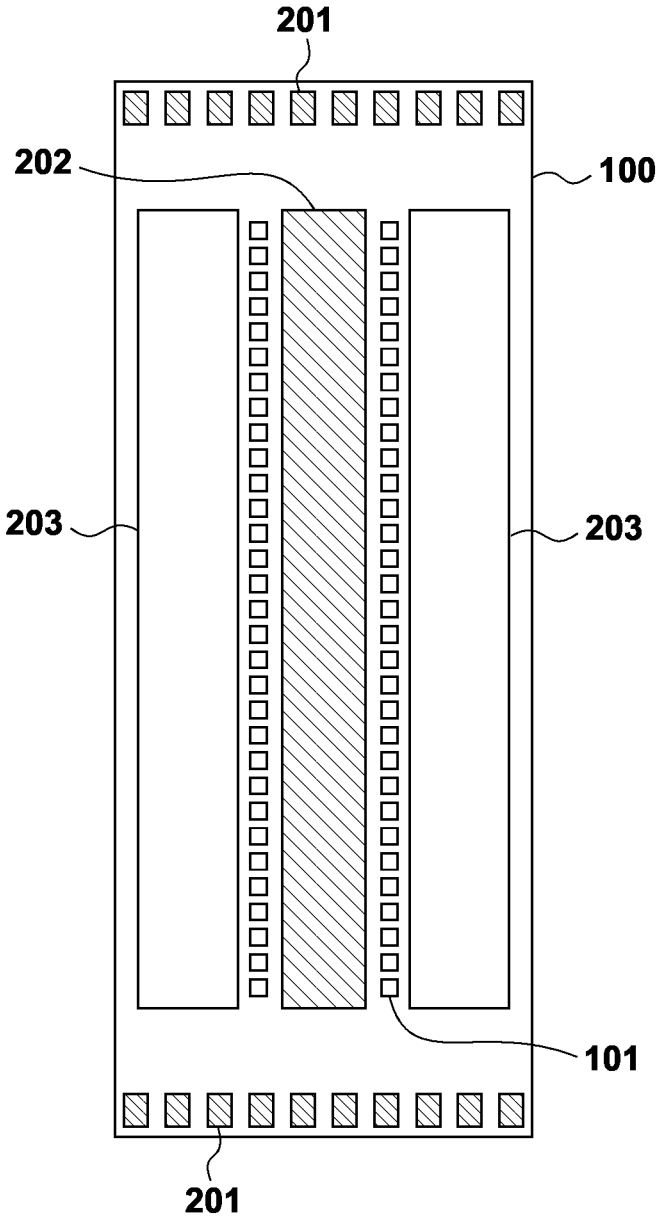
FIG. 3 is a view illustrating a layout configuration of an element substrate (head substrate) implemented on the printhead.

FIG. 3 is a plan view that illustrates a layout configuration of an element substrate 100 of a multi-layer structure implemented on the printhead 3. Note that, in FIG. 3, illustration regarding a member that forms a discharge port (orifice) is omitted.

As illustrated in FIG. 3, an ink supply port 202 that extends in a lengthwise direction is arranged in a central portion of the element substrate 100, and a plurality of electrothermal transducing elements (heaters) 101 are arrayed on the two sides of ink supply port 202 in columns respectively. The electrothermal transducing element 101 is formed from a Ta compound such as TaSiN. The thickness of the electrothermal transducing element 101 is approximately 0.01 to 0.05 μm, and is much smaller than the thickness of the later-described electrical wire.

Also, as illustrated in FIG. 3, on the two sides sandwiching the ink supply port 202, drive elements 203 for driving the electrothermal transducing elements 101 are arranged. The drive elements 203 are connected to electrode pads 201 arranged on the two sides in the lengthwise direction of element substrate 100, and generate a drive current for the electrothermal transducing elements 101 in accordance with a print signal supplied from outside (a main body portion of printing apparatus) of the printhead 3 via the electrode pads 201. Via a later-described electrical wire, the drive elements 203 and the electrothermal transducing elements 101 are connected electrically. The electrical wire is made up of aluminum, and its thickness is approximately 0.2 to 1.2 μm. The electrothermal transducing elements 101 generate heat by supplied current, and an electrothermal transducing element 101 that has reached a high temperature causes a bubble to form by heating the ink within a pressure chamber (described later). By such an air bubble, ink in the vicinity of the discharge port (orifice) is discharged from the discharge port, and printing is thereby performed.

Figure 4:
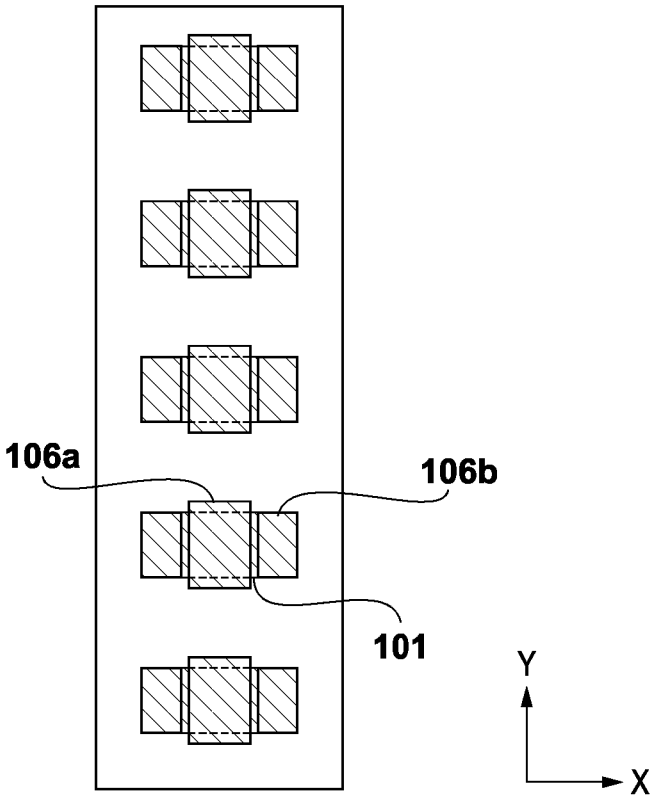
FIG. 4 is a top view illustrating an arrangement of an electrothermal transducing element on a head substrate.

FIG. 4 is a partial plan view of an element substrate in which a magnified configuration in the periphery of five electrothermal transducing elements is shown. In FIG. 4, the direction in which the electrothermal transducing elements are arrayed is the Y direction, and the direction orthogonal to that array direction is the X direction.

The electrothermal transducing element 101 is covered by a protective film made up of SiN as will be described later, and the thickness of that protective film is approximately 0.15 to 0.3 μm. Note that the protective film may be formed of SiO, SiC, SiOC, or SiCN. As illustrated in FIG. 4, an anti-cavitation film **106*a* covers immediately above a heated portion of the protective film. The anti-cavitation film 106*a* is made up of a material in which Ir is layered on Ta, and its thickness is approximately 0.05 to 0.3 μm, and is formed in the same layer as the electrical wire 106*b* (first electrical wire), but the anti-cavitation film 106*a* and the electrical wire 106*b*** are electrically separated.

Figure 5:
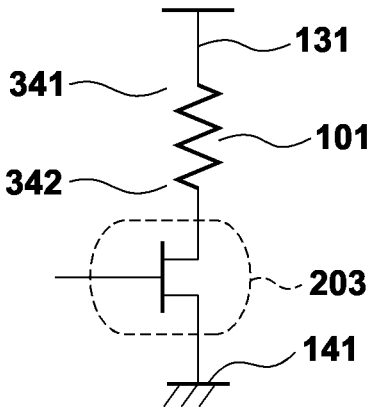
FIG. 5 is a view illustrating an equivalent circuit of a drive circuit for driving one electrothermal transducing element.

FIG. 5 is a view for illustrating an equivalent circuit of a drive circuit for driving one electrothermal transducing element (heater) in an element substrate.

As illustrated in FIG. 5, the connection portion 341 on one side of the electrothermal transducing element (heater) 101 is connected electrically to a VH common wire 131 for supplying voltage. Furthermore, the other the connection portion 342 of the heater 101 is electrically connected to a GND common wire 141 via a switching element 203 (driver) in order to switch whether driving of the heater 101 is off/on. The switching element 203 is a MOSFET in this embodiment, and a drive voltage from outside to the gate of the MOSFET is applied to switch it off/on, and thereby drive the heater 101.

Embodiments of the element substrate integrated on the printhead of the printing apparatus with the above configuration will be described next.

First Embodiment

Figure 6A:
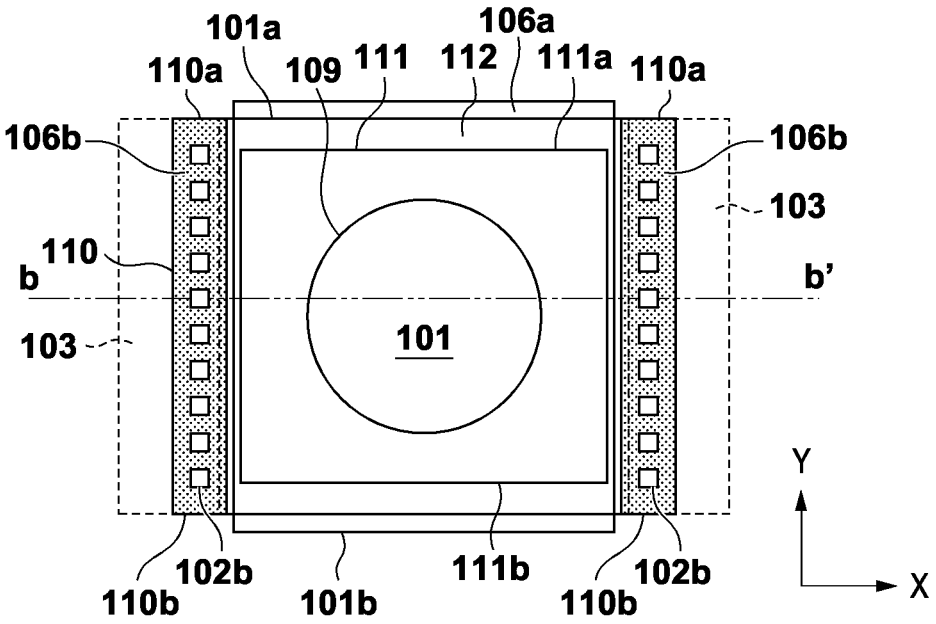
FIG. 6A is a plan view of a vicinity of one electrothermal transducing element in an element substrate according to the first embodiment.
Figure 6B:
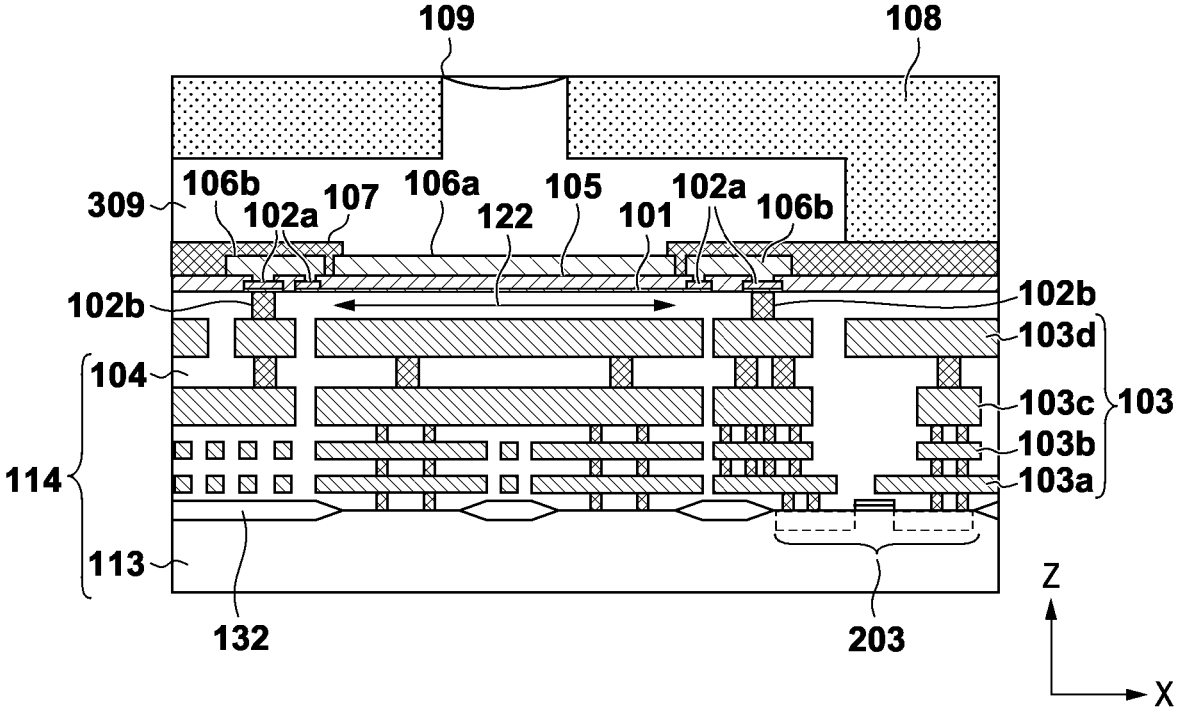
FIG. 6B is a cross-sectional view of a vicinity of one electrothermal transducing element in the element substrate according the first embodiment.

FIG. 6A to FIG. 6B are magnified schematic diagrams for the surrounding region of one electrothermal transducing element implemented on the element substrate illustrated in FIG. 4. FIG. 6A is a plan view of a vicinity of the electrothermal transducing element, and FIG. 6B is a cross-sectional view following the b-b' line of FIG. 6A.

In the description below, the direction in which current flows to the electrothermal transducing element is referred to as the first direction X or the X direction, and the direction orthogonal to the first direction X of the electrothermal transducing element is referred to as the second direction Y or the Y direction. The Y direction is the direction in which the electrothermal transducing elements and discharge ports are arrayed. A direction orthogonal to the X direction and the Y direction is referred to as the Z direction. The Z direction is a direction orthogonal to the discharge port formation surface, and follows the direction in which ink is discharged.

The element substrate 100 of the multi-layer structure includes a substrate 114 and a discharge port formation member 108. The substrate 114 includes a base member 113 formed by Si, and an insulation film 104 formed on the substrate 113. The electrothermal transducing element 101 which produces thermal energy to discharge ink, the protective film 105, the anti-cavitation film **106*a*, and the adhesion layer 107 are arranged on the substrate 114. The insulation film 104** is formed by an insulating body such as SiO.

A discharge port formation member 108 is arranged on the surface of the substrate 114 on which the electrothermal transducing element 101 is formed. The discharge port formation member 108 has a discharge port 109 corresponding to each electrothermal transducing element 101, and forms a pressure chamber 309 for each discharge port 109 together with the substrate 114. The pressure chamber 309 communicates with the ink supply port 202, and the ink supplied from the ink supply port 202 is introduced into the pressure chamber 309.

Within the insulation film 104 arranged in the substrate 114, the electrical wire 103 (second electrical wire) for supplying current to the electrothermal transducing element 101 extends. The electrical wire 103 is arranged so as to be embedded in the insulation film 104. The electrical wire 103, via later-described connection members 102*a* and 102*b* and the electrical wire 106*b*, electrically connects the drive element 203 and the electrothermal transducing element 101.

The electrothermal transducing element 101 is covered by the protective film 105. The protective film 105 is made up of SiN, and its thickness is approximately 0.15 to 0.3 μm. Immediately above the heated portion of the protective film 105 is covered by the anti-cavitation film 106*a*. The anti-cavitation film 106*a* is made up of a material in which Ir is layered on top of Ta, and its thickness is approximately 0.05 to 0.3 μm, and it is formed in the same layer as the electrical wire 106*b*, but the anti-cavitation film 106*a* and the electrical wire 106*b* are electrically separated.

Within the insulation film 104, a plurality of connection members 102*b* (first connection member) for connecting the electrical wire 103 and the electrical wire 106*b* are arranged. The plurality of connection member 102*b*, which extend in the film thickness direction (the Z direction), are positioned in the second direction Y with intervals between them.

In this embodiment, the connection member 102*a* is arranged between the connection member 102*b* and the electrical wire 106*b*. The connection member 102*b* is covered by the connection member 102*a* when viewed from a direction orthogonal to the surface on which the electrothermal transducing element 101 is arranged. The connection member 102*a* is formed by a low-resistance metal such as aluminum, and an electrical connection between the electrical wire 106*b* and the connection member 102*b* and an electrical connection between the electrical wire 106*b* and the electrothermal transducing element 101 are arranged to make a more reliable connection. The connection member 102*b*, in a vicinity of the two ends in the X direction of the electrothermal transducing element 101, connects with the electrothermal transducing element 101 via the connection member 102*a* and the electrical wire 106*b*. Accordingly, the current flows in the first direction X through the electrothermal transducing element 101. In the vicinities of the two ends in the X direction of the electrothermal transducing element 101, a plurality of the connection member 102*b* are respectively arranged.

There are connection regions 110 in which a plurality of the connection member 102*b* are connected via the connection member 102*a* and the electrical wire 106*b* to the two ends of the electrothermal transducing element 101, respectively. The connection member 102*b* is a plug that extends in the Z direction from the vicinity of the end of the electrical wire 103. The connection member 102*b* has an approximately square cross-section in this embodiment, but the corners may be rounded, and there is no limitation to a square; other shapes such as a rectangle, a circle, an ellipse, or the like may be taken. The connection member 102*b* is formed by tungsten, but it may be formed by any of titanium, platinum, cobalt, nickel, molybdenum, tantalum, or silicon, or by a compound of these. The connection member 102*b* may be formed to be integrated with the electrical wire 103. In other words, by cutting out a portion of the electrical wire 103 in the thickness direction, the connection member 102*b* may be formed to be integrated with the electrical wire 103.

The connection region 110 is a region that contains all of the connection members 102*b* and whose longer side at least encloses the electrothermal transducing element 101 in the Y direction. The connection region 110 extends in the second direction Y which is orthogonal to the first direction X, but the second direction need not be orthogonal to the first direction X. In other words, the connection region 110 may extend in a second direction that intersects the first direction X in a diagonal direction. In the electrothermal transducing element 101, a region that contributes to the actual bubbling of the ink, specifically a region where the ink bubbles, is referred to as a bubbling region 111. The bubbling region 111 is inside of an outer circumference of the electrothermal transducing element 101, and the region between the outer circumference of the bubbling region 111 and the electrothermal transducing element 101 is a region (hereinafter, a frame region 112) that does not contribute to ink bubbling.

Even in the frame region 112, heat is generated due to electrification, but the amount of heat dissipation to the periphery is large, and so the ink does not bubble. Accordingly, cavitation does not occur above the frame region 112, and it is sufficient if the anti-cavitation film 106*a* can enclose the bubbling region 111. The dimensions in the X direction and the Y direction of the bubbling region 111 are decided based on the structure in the periphery of the electrothermal transducing element 101 and the coefficient of heat conductivity of the electrothermal transducing element 101, and the like. The connection regions 110 sandwich the frame region 112, and are adjacent to the bubbling region 111 in the first direction X, and extend across a region containing the entire length of the bubbling region 111 in the second direction Y.

That is, when viewed in the first direction X, the two ends 110*a* and 110*b* in the Y direction of the connection region 110 are closer to the two peripheral edge portions 101*a* and 101*b* in the Y direction of the electrothermal transducing element 101 than the two peripheral edge portions 111*a* and 111*b* in the Y direction of the bubbling region 111. Accordingly, the current density is uniform across the entirety of the bubbling region 111. Also, when electrical insulation is needed between the ink and the electrical wire 103, there is a need to cover the electrical wire 106*b* and the connection member 102*a* with a film that has insulation properties. In this embodiment, the adhesion layer 107 arranged between the discharge port formation member 108 and the substrate 114 is used as an insulation film. For the adhesion layer 107, it is possible to use a material such as SiO SiN, or SiCN.

Note that in FIG. 6B, reference numeral 122 illustrates the length of the anti-cavitation film 106*a* in the X direction.

As illustrated in FIG. 6B, the electrical wire 103 is arranged in the insulation film 104, and is connected to the electrothermal transducing element 101 via the connection members 102*a* and 102*b*. Accordingly, to make an electrical connection from the back surface side (the opposite side to the side on which it contacts with the ink) to the electrothermal transducing element 101, it is possible to make the surface area of the electrical wire covering the front surface side (side contacting the ink) of the electrothermal transducing element 101 smaller. In the configuration of the conventional example in which the electrical wire is connected to the front surface side of the electrothermal transducing element 101, an electrical wire whose thickness is approximately 0.6 to 1.2 μm is layered on top of the electrothermal transducing element 101, and level differences are present in many regions on the surface of a substrate. Therefore, it is necessary to provide a protective film of a relatively large thickness in order to ensure the coverage with respect to the front surface having a region with many level differences of approximately 0.6 to 1.2 μm.

In relation to this, in this embodiment, the electrical wire provided on the front surface side of the electrothermal transducing element 101 is a very small region. Also, it is sufficient that the thickness of the connection member 102*a* enables a reliable electrical connection, and it is desirable that it be approximately 0.1 to 0.3 μm. Regions with a level difference and height differences become particularly small compared with conventional configurations since the thickness of the electrothermal transducing element 101 is a value that is close to 0.01 to 0.05 μm, approximately.

Consequently, in accordance with this embodiment, the protective film 105 can be made thinner since it is possible to ensure sufficient coverage by the protective film 105 whose thickness is approximately 0.15 to 0.3 μm, and the efficiency of heat transfer to the ink is improved remarkably. This can contribute not only to a reduction in power consumption but also can contribute to image quality improvement for images printed with stabilized bubbling. In addition, it is possible to expect improvement in the reliability of patterning precision of the anti-cavitation film 106*a*, and improvement in adhesion to the substrate 114 of the discharge port formation member 108 and processing accuracy and the like, and so there are advantages in terms of manufacturing and not just image quality improvement.

Furthermore, in the case of conventional configurations that connect the electrothermal transducing element 101 with the connection member 102*b* directly, when the electrothermal transducing element 101 is disconnected due to the influence of an incidental abnormal pulse or the like, an insulation breakdown occurs in the protective film 105 of the high temperature state, and a large current flows in the direction of the anti-cavitation film 106*a*. At that time, the large current flows to the connection member 102*b* and reaches a high temperature locally, and there are cases where instantaneously the connection member 102*b* is lost due to melting or shock, and the region of the connection member 102*b* becomes a cavity. In such a case, the ink (liquid) reaches the electrical wire 103 through the cavity, wiring corrosion due to an electrochemical reaction is induced, and there are cases where the electricity supply to the adjacent electrothermal transducing element is affected.

However, by virtue of the above-described embodiment, even if such an incidental disconnection occurs, the connection member 102*b* does not melt and is not lost, and the ink (liquid) does not reach the electrical wire 103. This is because the connection member 102*b* is separated from the heat generation region 111, and since it is separated from the region that caused an insulation breakdown in the protective film 105, the connection member 102*b* does not reach a high temperature, and a damaging shock does not occur. The result of this is that it is possible to prevent wiring corrosion, and it is possible to localize incidental disconnection to that segment only. Also, by forming the electrical wire 106*b* for electrically connecting the connection member 102*b* and the electrothermal transducing element in the same layer as the anti-cavitation film 106*a* (the same manufacturing step), it is possible to prevent an increase in manufacturing burden.

Also, in a case of an element substrate on which a temperature sensor or the like for detecting a discharge state, for example, is arranged directly under the electrothermal transducing element, the arrangement of the connection member 102*b* may restrict the circuit design. However, in this embodiment, the connection member 102*b* is distanced from immediately below the electrothermal transducing element, and so design flexibility is improved.

Also, to attain a more uniform ink discharge characteristic across the plurality of discharge ports, high precision control in relation to bubbling variability and resistance variability is necessary, and therefore it is advantageous for an underlayer (lower region) of the electrothermal transducing element 101 to be level. Conventionally, it was difficult to arrange a wiring pattern or the like so that level differences did not occur directly under and in the periphery of the electrothermal transducing element.

In a configuration according to this embodiment, an underlayer portion of the electrothermal transducing element 101 and the electrical wire 103 formed in each layer of the element substrate is planarized by CMP processing or the like. Accordingly, by planarizing the underlayer (under region) of the formation layer of the electrothermal transducing element, it becomes possible to have a signal line, power source wiring, and the like pass through the electrical wire 103 of a pattern in the insulation film 104 directly under the electrothermal transducing element 101 or in the periphery thereof. Furthermore, since it becomes possible to arrange a transistor in that region, the surface area of the element substrate 100 can be made smaller, and a printhead cost reduction and an increased density of the discharge port 109 become possible. In this embodiment, the drive element (switching element) 203 and a field oxidation film 132 are formed in the region of the boundary with the insulation film 104 of the base member 113 formed out of Si as illustrated in FIG. 6B.

By the above-described configuration, the effect on the characteristics of the electrothermal transducing element 101 is reduced, and multi-layering of the electrical wire 103 is enabled. Accordingly, it becomes possible to significantly reduce power source wiring resistance by assigning a plurality of wiring layers to the electrical wire 103, and it becomes possible to realize power saving and uniformization of the energy inputted to the electrothermal transducing element 101.

As illustrated in FIG. 6B, the electrical wire 103 is a configuration of four layers 103*a* to 103*d* whose distances from the formation layer of the electrothermal transducing element 101 are different to each other. Also, electric wiring layers 103*a* and 103*b* on the lower layer side are allocated to the signal line layer and the logic power source wiring layer for driving the electrothermal transducing element 101. Also, electric wiring layers 103*c* and 103*d* of the upper layer side (the insulation film side) are allocated in the wiring layer for supplying current to the electrothermal transducing element 101.

In this embodiment, electric wiring layer 103*d* is a ground (GNDH) wiring layer (first electric wiring layer 103*d*), electric wiring layer 103*c* is a power supply (VH) wiring layer (second electric wiring layer 103*c*), and electric wiring layer 103*c* and 103*d* are both so-called plane wiring. Accordingly, multilayer wiring in which a first electric wiring layer and a second electric wiring layer of the power supply system are formed in different layers is employed, and by configuring (plane wiring) to arrange these electric wiring layers in the entire surface of the element substrate, an increase in size of the element substrate 100 can be prevented and wiring resistance can be made very small.

This embodiment includes, in the insulation film 104, the four electric wiring layers of the electric wiring layers 103*c* and 103*d* for supplying current to the electrothermal transducing element 101 and the electric wiring layers 103*a* and 103*b* which are a signal line layer and a logic power source wiring layer for driving the electrothermal transducing element 101. The electric wiring layers 103*c* and 103*d* are disposed on the side closer to the electrothermal transducing element 101 in relation to the electric wiring layers 103*a* and 103*b*, and the thickness of the electric wiring layers 103*c* and 103*d* advantageously considers the fact that relatively thicker is more efficient. Conversely, electric wiring layers 103*a* and 103*b* are disposed on the side closer to the drive element 203 in relation to the electric wiring layers 103*c* and 103*d*, and the thickness of the electric wiring layers 103*a* and 103*b* is advantageously relatively thin.

Second Embodiment

Differences from the element substrate according to the first embodiment will be described for the element substrate according to this embodiment, with reference to the figures.

Figure 7A:
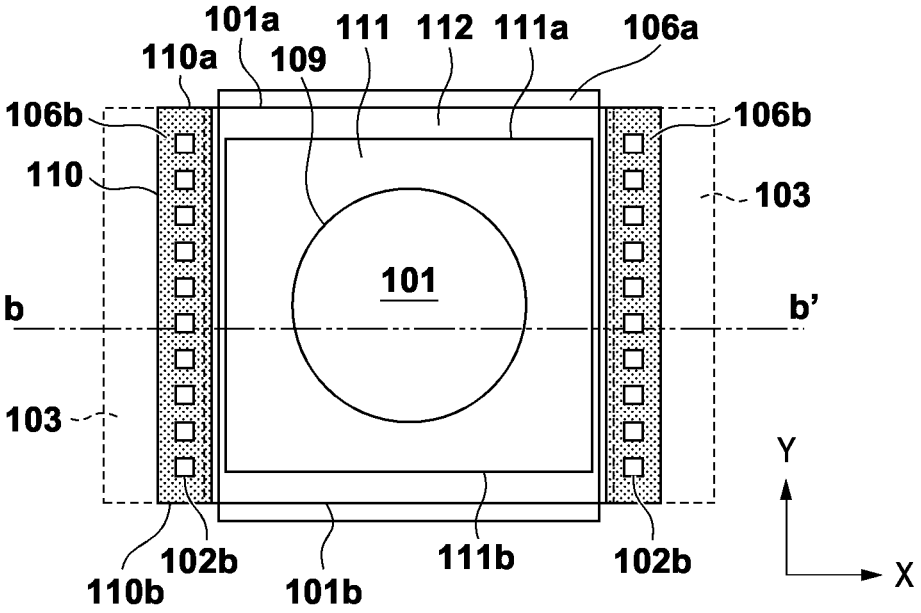
FIG. 7A is a plan view of a vicinity of one electrothermal transducing element in an element substrate according to a second embodiment.
Figure 7B:
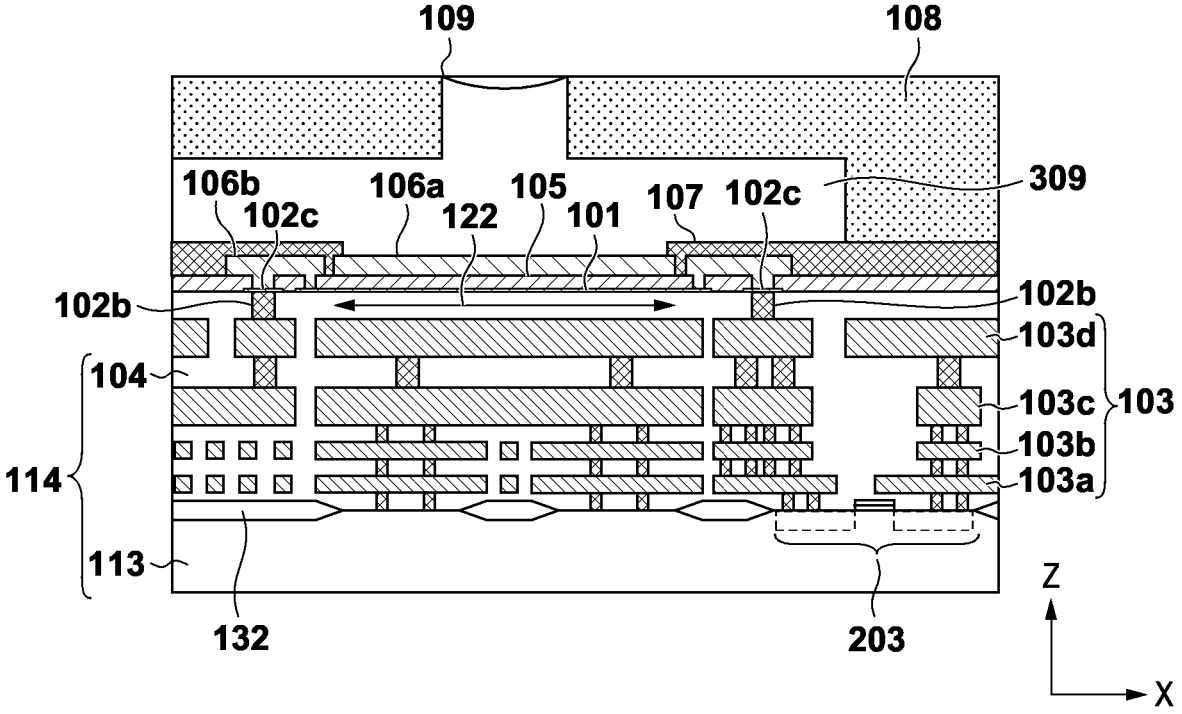
FIG. 7B is a cross-sectional view of a vicinity of one electrothermal transducing element in the element substrate according to the second embodiment.

FIG. 7A and FIG. 7B are magnified schematic diagrams for the surrounding region of one electrothermal transducing element of the element substrate 100 illustrated in FIG. 3. FIG. 7A is a plan view of the vicinity of the electrothermal transducing element, and FIG. 7B is a cross-sectional view following the b-b' line of FIG. 7A. Note that, in FIGS. 7A and 7B, the same reference numbers are given to same components as were described with reference to FIGS. 6A and 6B already, and description thereof is omitted.

According to FIG. 7A and FIG. 7B, the connection member 102*c* formed in the same layer as the electrothermal transducing element 101 is arranged in the region corresponding to the connection member 102*b* illustrated in FIG. 6A and FIG. 6B. Here, a portion of the electrical wire 106*b* extends through the formation layer of the protective film 105 and is connected to the connection member 102*c*.

In such a configuration as well, it is not only possible to achieve an equivalent effect to the first embodiment, but it is possible to further reduce the level difference of the surface of the electrothermal transducing element 101 over the first embodiment.

Third Embodiment

Differences from the element substrate according to the first embodiment will be described for the element substrate according to this embodiment, with reference to the figures.

Figure 8A:
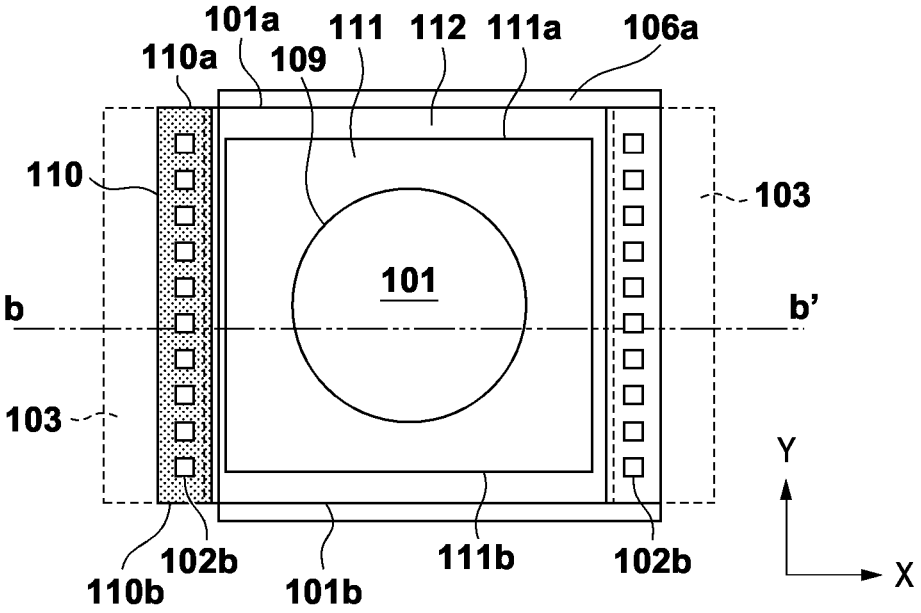
FIG. 8A is a plan view of a vicinity of one electrothermal transducing element in an element substrate according to a third embodiment.
Figure 8B:
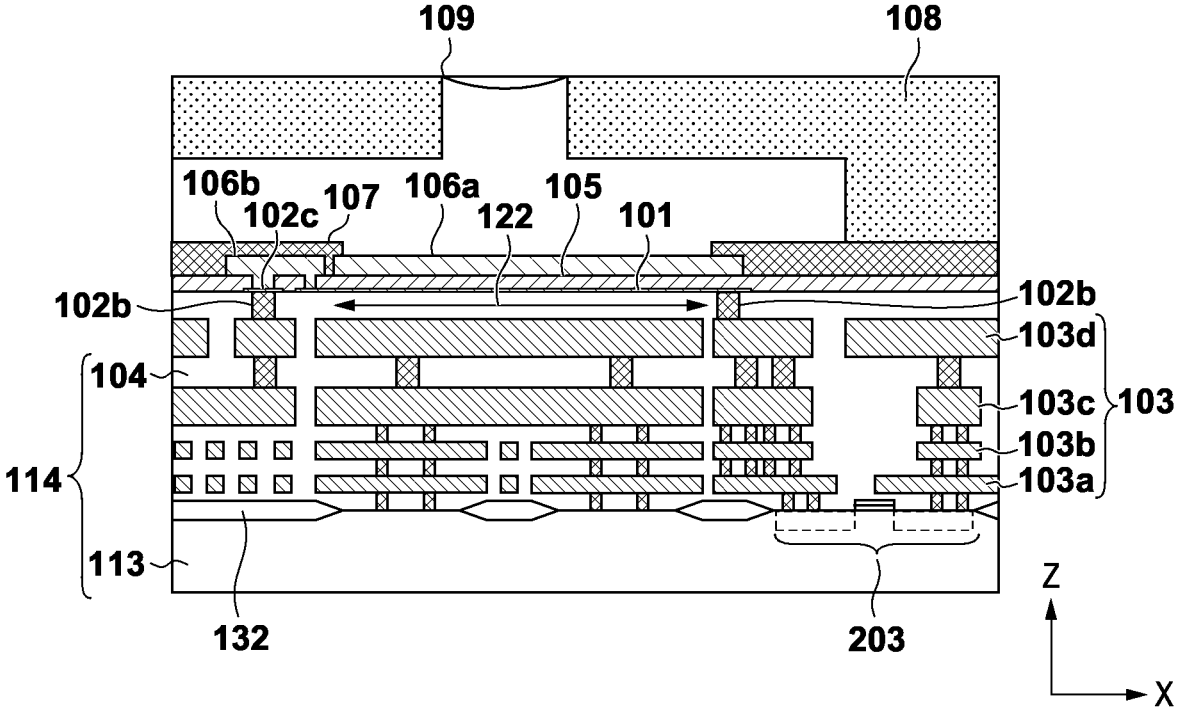
FIG. 8B is a cross-sectional view of a vicinity of one electrothermal transducing element in the element substrate according to the third embodiment.

FIG. 8A and FIG. 8B are magnified schematic diagrams for the surrounding region of one electrothermal transducing element implemented on the element substrate 100 illustrated in FIG. 3. FIG. 8A is a plan view of the vicinity of the electrothermal transducing element, and FIG. 8B is a cross-sectional view following the b-b line of FIG. 8A. Note that, in FIGS. 8A and 8B, the same reference numbers are given to same components as were described with reference to FIGS. 6A and 6B already, and description thereof is omitted.

According to FIGS. 8A and 8B, only the connection region on the side on which a high electric potential is applied in the region corresponding to the connection member 102*a* illustrated in FIGS. 6A and 6B is configured to connect the electrothermal transducing element 101 and the electrical wire 103 via the electrical wire 106*b*. Meanwhile, the low electric potential side is configured to connect the electrothermal transducing element 101 directly with the connection member 102*b*.

In the case where the electrothermal transducing element 101 is incidentally disconnected, the possibility that only the electrode of the high electric potential side will be damaged instantaneously is very high. Consequently, even if a configuration that arranges the electrical wire 106*b* in only the connection region on the high electric potential side is employed as in this embodiment, it is possible to reduce the possibility of ink intruding due to damage to the connection portion.

Accordingly, not only can this embodiment achieve an equivalent effect to the first embodiment, it has the advantages that it can achieve improvements in design freedom in relation to the connection portion on the low electric potential side, and flexibility with respect to the size and arrangement of the electrothermal transducing element 101 and the like can be improved.

In all of the first to third embodiments described above, it is possible to make the portion arranged on the side that contacts with the ink of the element substrate for the connection portion between the electrothermal transducing element and the electrical wire smaller. By this, even if by any chance a disconnection occurs, the possibility that the ink will intrude into the element substrate is kept low, and it is possible to prevent the influence of disconnection on other portions. In addition, since it is possible to make the thickness of the protective film of the electrothermal transducing element smaller, it is possible to convey thermal energy generated in the electrothermal transducing element to the ink efficiently, and it is conducive to reduction in printing operation power consumption.

Note that in the above-described embodiment, the printhead that discharges ink and the printing apparatus have been described as an example, but the present invention is not limited to this. The present invention can be applied to an apparatus such as a printer, a copying machine, a facsimile apparatus including a communication system, or a word processor including a printer unit, and an industrial printing apparatus complexly combined with various kinds of processing apparatuses. In addition, the present invention can also be used for the purpose of, for example, biochip manufacture, electronic circuit printing, color filter manufacture, or the like.

The printhead described in the above embodiment can also be considered as a liquid discharge head in general. The substance discharged from the head is not limited to ink, and can be considered as a liquid in general.

The present invention is not limited to the above embodiments and various changes and modifications can be made within the spirit and scope of the present invention. Therefore, to apprise the public of the scope of the present invention, the following claims are made.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-097144, filed on Jun. 3, 2020, which is hereby incorporated by reference herein in its entirety.

What is claimed is:

1. An element substrate of multi-layer structure comprising:

an electrothermal transducing element formed in a first layer;

a protective film covering the electrothermal transducing element;

an anti-cavitation film formed on the protective film and for protecting the electrothermal transducing element from a shock;

a first electrical wire formed in the same layer as the anti-cavitation film, in a direction orthogonal to a planar face of the element substrate, a portion of the first electrical wire being arranged to be separated from the anti-cavitation film, and electrically connected to at least one end of the electrothermal transducing element;

a second electrical wire formed in a second layer that is positioned on an opposite side of the protective film with respect to the electrothermal transducing element; and a first connection member that extends between the first layer and the second layer, that electrically connects the first electrical wire and the second electrical wire, and that is arranged to be separated from the electrothermal transducing element in the direction orthogonal to the planar face, wherein the anti-cavitation film and the first electrical wire are provided so as not to overlap with each other in the direction orthogonal to the planar face.

2. The element substrate according to claim 1, further comprising a second connection member arranged between the first connection member and the first electrical wire, and connecting the first connection member and the first electrical wire, wherein the first electrical wire is arranged on both ends of the electrothermal transducing element.

3. The element substrate according to claim 2, wherein the second connection member is formed of a low-resistance metal, and the metal is aluminum.

4. The element substrate according to claim 2, wherein two ends of the electrothermal transducing element are each connected to the second electrical wire via the first electrical wire, the first connection member, and the second connection member.

5. The element substrate according to claim 2, wherein the second connection member is formed in the first layer, and a portion of the first electrical wire extends through the protective film and is connected to the second connection member.

6. The element substrate according to claim 1, wherein the first electrical wire is connected to an end on one side of the electrothermal transducing element, and the end on the other side of the electrothermal transducing element is connected to the second electrical wire via the first connection member.

7. The element substrate according to claim 6, wherein the end on the one side of the electrothermal transducing element is a high electric potential side.

8. The element substrate according to claim 1, wherein the first electrical wire is covered by an insulating film.

9. The element substrate according to claim 1, wherein the anti-cavitation film and the first electrical wire are electrically separated.

10. The element substrate according to claim 1, wherein a drive element for driving the electrothermal transducing element is formed in a third layer that is below the second layer.

11. The element substrate according to claim 1, wherein the thickness of the electrothermal transducing element is 0.01 to 0.05 μm, the thickness of the protective film is 0.15 to 0.3 μm, and the thickness of the anti-cavitation film is 0.05 to 0.3 μm.

12. The element substrate according to claim 1, wherein a plurality of electrothermal transducing elements is arrayed in a predetermined direction.

13. A liquid discharge head that uses an element substrate according to claim 12, comprising a plurality of discharge ports for discharging liquid in correspondence with the plurality of electrothermal transducing elements, wherein the plurality of electrothermal transducing elements contact the liquid via the anti-cavitation film.

14. A printing apparatus operable to use the liquid discharge head according to claim 13 as a printhead, wherein the liquid is ink, and the printhead is used to discharge the ink, and thereby print onto a print medium, and the plurality of electrothermal transducing elements contacts the ink, and by driving the plurality of electrothermal transducing elements, the ink is discharged from discharge ports.

* * * * *